US007291059B2

(12) United States Patent
Sugita et al.

(10) Patent No.: US 7,291,059 B2
(45) Date of Patent: Nov. 6, 2007

(54) PROCESS AND APPARATUS FOR CUTTING SHEET GLASS

(75) Inventors: Takechika Sugita, Miyazaki (JP); Kenji Hirano, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 251 days.

(21) Appl. No.: 10/840,753

(22) Filed: May 6, 2004

(65) Prior Publication Data

US 2004/0250668 A1 Dec. 16, 2004

(30) Foreign Application Priority Data

May 20, 2003 (JP) ..... 2003-141394

(51) Int. Cl.
*B24B 1/00* (2006.01)

(52) U.S. Cl. ..... 451/38; 451/41

(58) Field of Classification Search ..... 83/51, 83/53, 862, 864, 869, 875, 876, 880, 883, 83/885; 451/38, 41; 225/2, 93, 96.5
See application file for complete search history.

(56) References Cited

U.S. PATENT DOCUMENTS

| | | | | |
|---|---|---|---|---|
| 4,044,639 | A * | 8/1977 | Kato | 83/880 |
| 4,073,094 | A * | 2/1978 | Walz | 451/41 |
| 4,956,034 | A * | 9/1990 | Shinozaki et al. | 156/102 |
| 4,988,027 | A * | 1/1991 | Bremner | 225/2 |
| 5,363,603 | A * | 11/1994 | Miller et al. | 451/40 |
| 5,369,060 | A * | 11/1994 | Baumann et al. | 438/460 |
| 5,584,016 | A * | 12/1996 | Varghese et al. | 700/97 |
| 6,148,706 | A * | 11/2000 | Witjes | 83/495 |
| 6,271,102 | B1 * | 8/2001 | Brouillette et al. | 438/462 |
| 6,385,998 | B1 * | 5/2002 | Mizuno | 65/105 |
| 6,565,420 | B2 * | 5/2003 | Lisec | 451/38 |
| 6,774,978 | B2 * | 8/2004 | Shin | 349/187 |
| 2002/0014092 | A1 * | 2/2002 | Morishita et al. | 65/63 |
| 2002/0046576 | A1 * | 4/2002 | Campbell | 65/56 |
| 2002/0119298 | A1 * | 8/2002 | Sugawa et al. | 428/220 |
| 2003/0012957 | A1 * | 1/2003 | Sugawa et al. | 428/413 |
| 2004/0050105 | A1 * | 3/2004 | Morishita et al. | 65/63 |
| 2005/0079797 | A1 * | 4/2005 | Marti et al. | 451/5 |

FOREIGN PATENT DOCUMENTS

| | | | |
|---|---|---|---|
| EP | 503647 | A2 * | 9/1992 |
| JP | 60-231427 | | 11/1985 |
| JP | 05-201737 | | 8/1993 |
| JP | 11000787 | * | 1/1999 |
| JP | 2000-052299 | | 2/2000 |

* cited by examiner

*Primary Examiner*—M. Rachuba
(74) *Attorney, Agent, or Firm*—Carrier, Blackman & Associates, P.C.; Joseph P. Carrier; William D. Blackman

(57) ABSTRACT

A process for cutting a sheet glass includes a first step of forming a groove conformed to a cutting shape in one surface of a sheet glass by a water jet, and a second step of forming a groove in the other surface of the sheet glass by a water jet to reach the groove, which are carried out sequentially, thereby cutting the sheet glass. Thus, the sheet glass can be cut by the water jets, while preventing occurrence of breaking or cranking, without need for a post-processing.

2 Claims, 5 Drawing Sheets

PROCESS AND APPARATUS FOR CUTTING SHEET GLASS

BACKGROUND OF THE INVENTION

1. Field of the Invention

The present invention relates to improvements in a process for cutting a sheet glass by a water jet, and a cutting apparatus for carrying out the cutting process.

2. Description of the Related Art

A technique for cutting a sheet glass by a water jet is already known, for example, from Japanese Patent Application Laid-open No. 5-201737.

In the conventional technique, when a sheet glass is cut using a water jet, a water flow is injected from a water jet nozzle onto the sheet glass only from one side of the sheet glass so that the water flow penetrates the sheet glass. In such a case where a fragile material such as sheet glass is cut by the penetration of the water flow, breaking or cracking is liable to occur in the other surface when the water flow penetrates the sheet glass from the one surface to the other surface. Even when the breaking or cracking does not occur, an edge of the cut portion on the other surface of the sheet glass is sharpened, and hence it is necessary to conduct a chamfering treatment after the cutting.

SUMMARY OF THE INVENTION

Accordingly, it is an object of the present invention to provide a process and apparatus for cutting a sheet glass, wherein the sheet glass can be cut without need for a post-processing, while preventing occurrence of breaking or cracking.

To achieve the above object, according to a first feature of the present invention, there is provided a process for cutting a sheet glass by a water jet, comprising a first step of forming a groove corresponding to a cutting shape in one surface of the sheet glass by a water jet, and a second step of forming a groove in the other surface of the sheet glass by a water jet to reach the groove formed at the first step.

With the arrangement of the first feature, the sheet glass is cut by forming the grooves in the opposite surfaces of the sheet glass by the water jets applied from the opposite sides of the sheet glass. Therefore, it is possible to prevent, to the utmost, breaking or cracking which is liable to occur when the water flow of the water jet penetrates the sheet glass, and moreover a sharp edge produced by the penetration of the water flow is not created, thus it is unnecessary to conduct a post-processing such as a chamfering.

According to a second feature of the present invention, in addition to the arrangement of the first feature, the first and second steps are carried out in water. With such arrangement, it is possible to inhibit the bouncing-back of the cutting water which may occur as the water flow does not penetrate the sheet glass, and to suppress generation of noise due to collision of the water flow against the sheet glass.

According to a third feature of the present invention, in addition to the arrangement of the first or second feature, the cutting apparatus comprises a retaining plate which is capable of being turned over through 180 degrees with the sheet glass releasably retained on one surface thereof and which is provided with an opening surrounding the cutting shape of the sheet glass, and a jet nozzle capable of moving in correspondence to the cutting shape, while injecting an water flow containing an abrasive toward the sheet glass retained on the retaining plate. With such arrangement, the water flows from the water jet nozzles can be injected toward opposite surfaces of the sheet glass, while being moved in correspondence to the cutting shape, and the cutting process for cutting the sheet glass by forming the grooves by the water jets from the opposite sides of the sheet glass can be carried out easily in a simple structure.

According to a fourth feature of the present invention, in addition to the third feature, the cutting apparatus further includes a glass transferring means which has a plurality of the retaining plates and which transfers each of the retaining plates between first and second processing stations provided at a distance from each other and turns over the retaining plate through 180 degrees during transfer of each of the retaining plate between the first and second processing stations, wherein a pair of water jet nozzles are disposed on the first and second processing stations and synchronously injects the water flows containing an abrasive. With such arrangement, the sheet glass can be cut effectively, while being transported by the glass transporting means and thus, a large number of sheet glasses can be cut with a good efficiency.

According to a fifth feature of the present invention, in addition to the arrangement of the third or fourth feature, high-pressure water supply sources having a water pressure set in a range of 200 to 294 MPA and abrasive supply sources for supplying an abrasive at a rate in a range of 100 to 200 g/min are connected to the water jet nozzles, respectively, and NC devices for moving the water jet nozzles at a speed in a range of 2,000 to 5,000 mm/min are also connected to the water jet nozzles, respectively. With such arrangement, the water jet nozzles can be moved in a locus conformed to the cutting shape with a good accuracy, so that the sheet glass can be cut under optimal conditions in which a cutting quality is enhanced.

According to a sixth feature of the present invention, in addition to the arrangement of the fifth feature, the cutting shape is determined in correspondence to a contour of a mirror for a vehicle, and the NC devices are capable of moving the water jet nozzles in a three-dimensional space. With such arrangement, a mirror for a vehicle can be produced appropriately.

The above and other objects, features and advantages of the invention will become apparent from the following description of a preferred embodiment taken in conjunction with the accompanying drawings.

DESCRIPTION OF THE PREFERRED EMBODIMENT

The present invention will now be described by way of an embodiment shown in the accompanying drawings.

Figure 1:
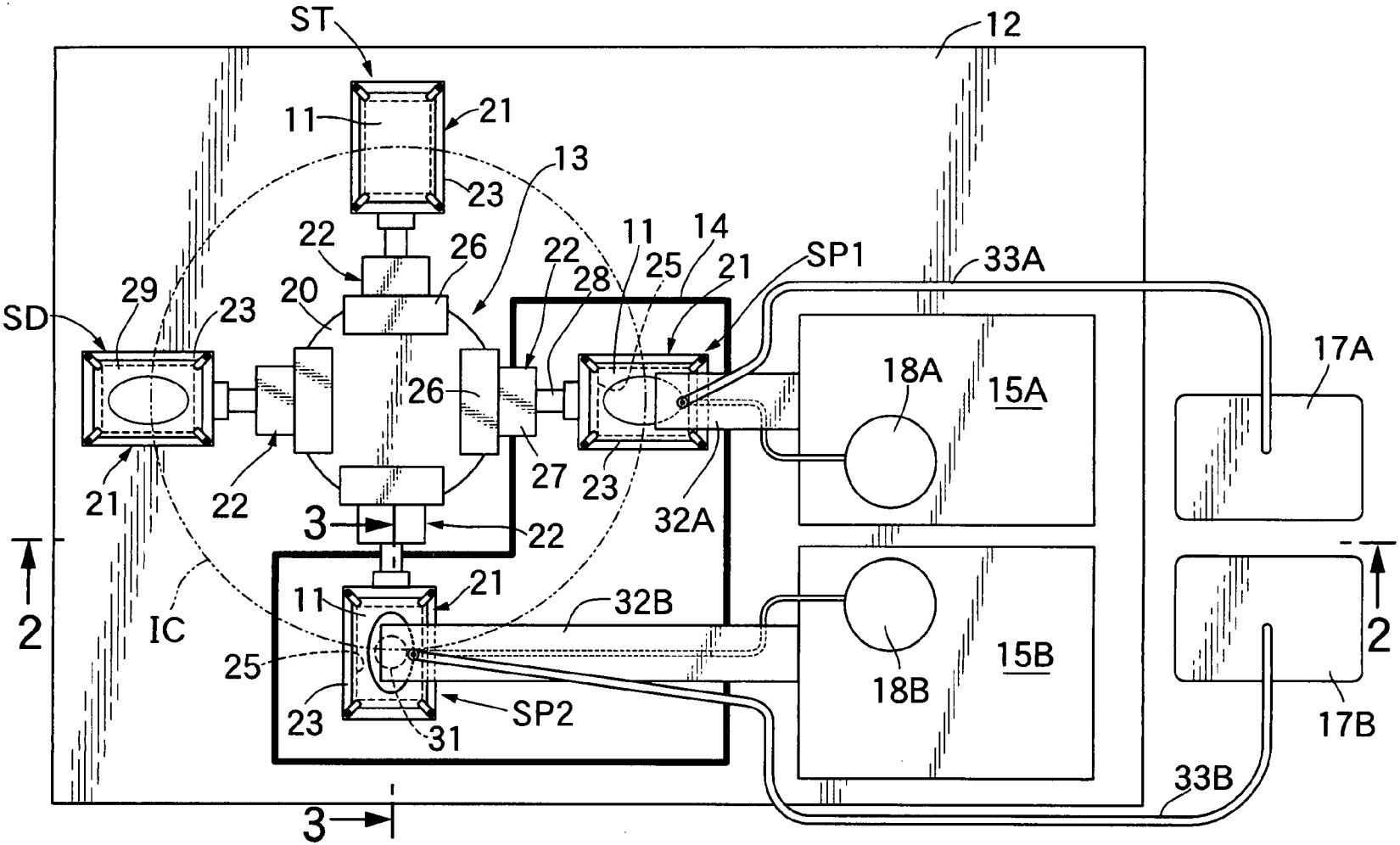
FIG. 1 is a plan view of a cutting apparatus according to an embodiment of the present invention.
Figure 2:
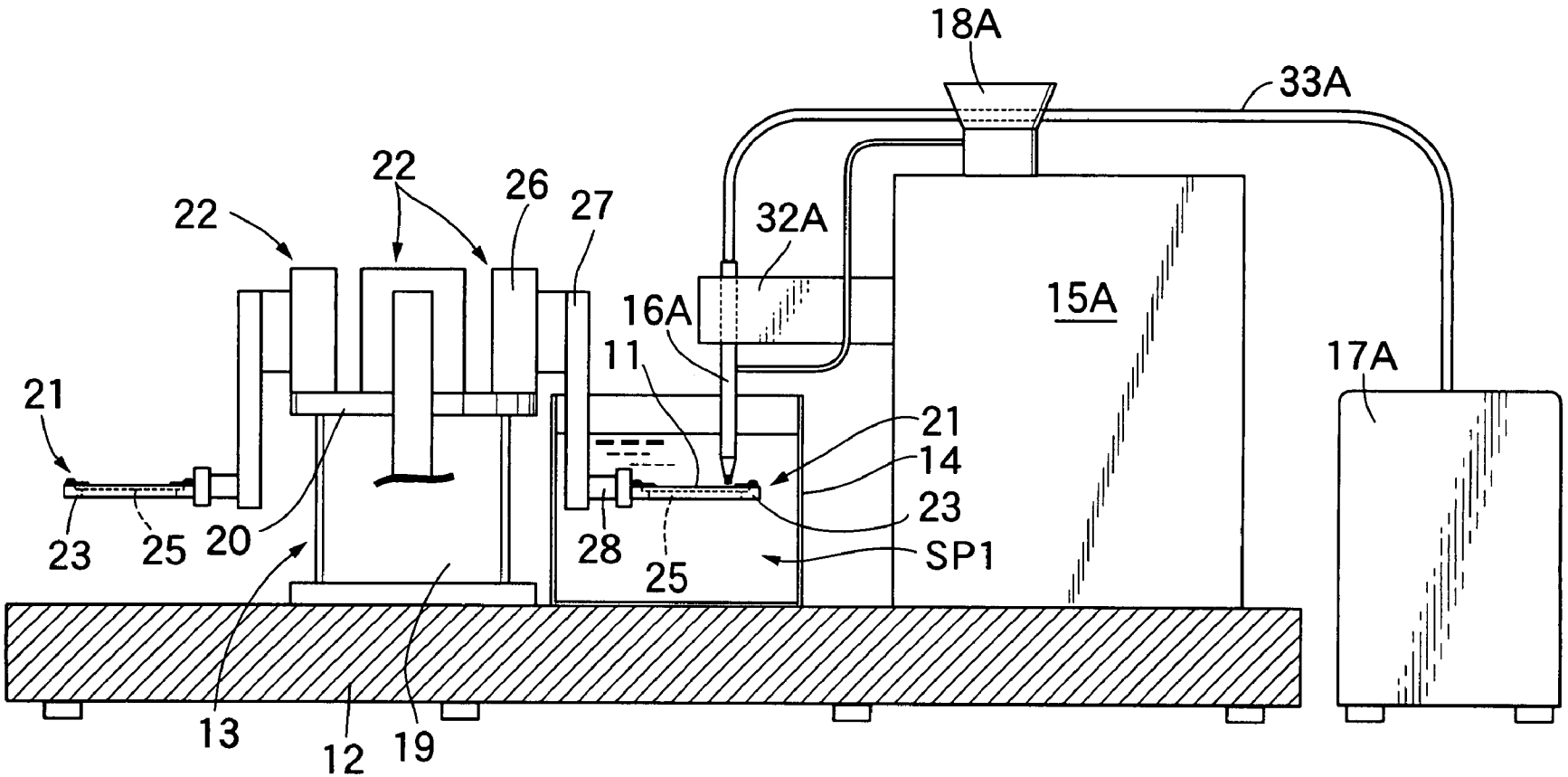
FIG. 2 is a sectional view taken along a line 2-2 in FIG. 1.

Referring first to FIGS. 1 and 2, a cutting apparatus is adapted to cut a sheet glass 11 to produce a mirror for a vehicle, and includes a stationary base 12, a glass transferring means 13 disposed on the base 12, a water tank 14 disposed on the base 12 to store water, a pair of NC devices 15A and 15B disposed on the base 12 on a side of the water tank 14, water jet nozzles 16A and 16B individually connected to the NC devices 15A and 15B, respectively, high-pressure water supply sources 17A and 17B connected to the water jet nozzles 16A and 16B, respectively, and abrasive supply sources 18A and 18B connected to the water jet nozzles 16A and 16B, respectively.

A throw-in station ST, a first processing station SP1, a second processing station SP1 and a discharge station SD are provided at intervals of 90° on an imaginary circle IC. The glass transferring means 13 is constructed to transfer the sheet glass 11 sequentially to the stations ST, SP1, SP2 and SD.

The glass transferring means 13 includes a support column 19 fixed on the base 12 at the center of the imaginary circle IC, a circular table 20 carried at an upper end of the supporting column 19 to turn by 90° at a time about the center of the imaginary circle IC, four retainers 21 disposed at intervals of 90° on the imaginary circle IC, and lifting/turning mechanisms 22 disposed at intervals of 90° around an outer periphery of the table 20 and connected individually to the retainers 21.

Figure 3:
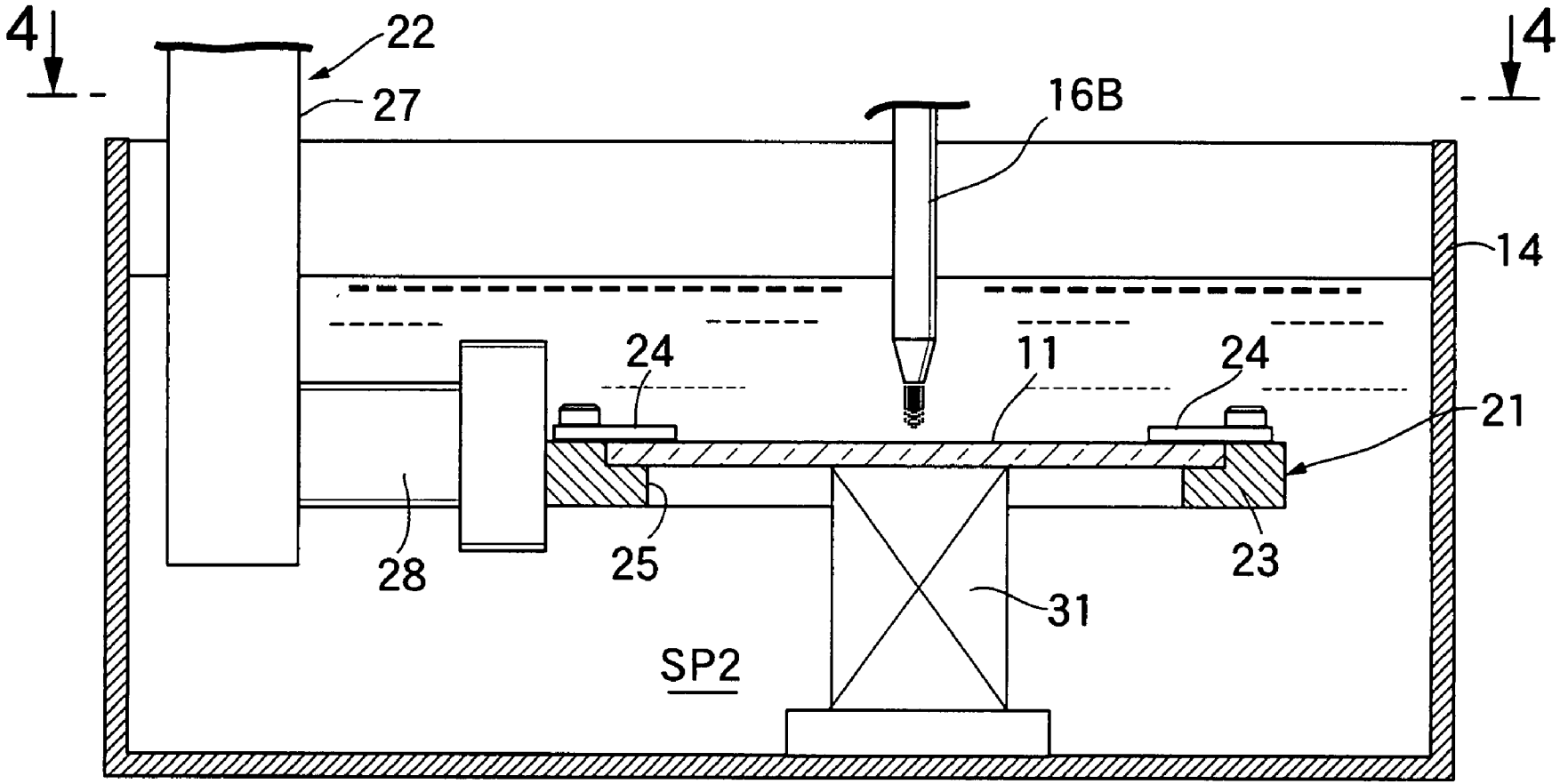
FIG. 3 is an enlarged sectional view taken along a line 3-3 in FIG. 1.
Figure 4:
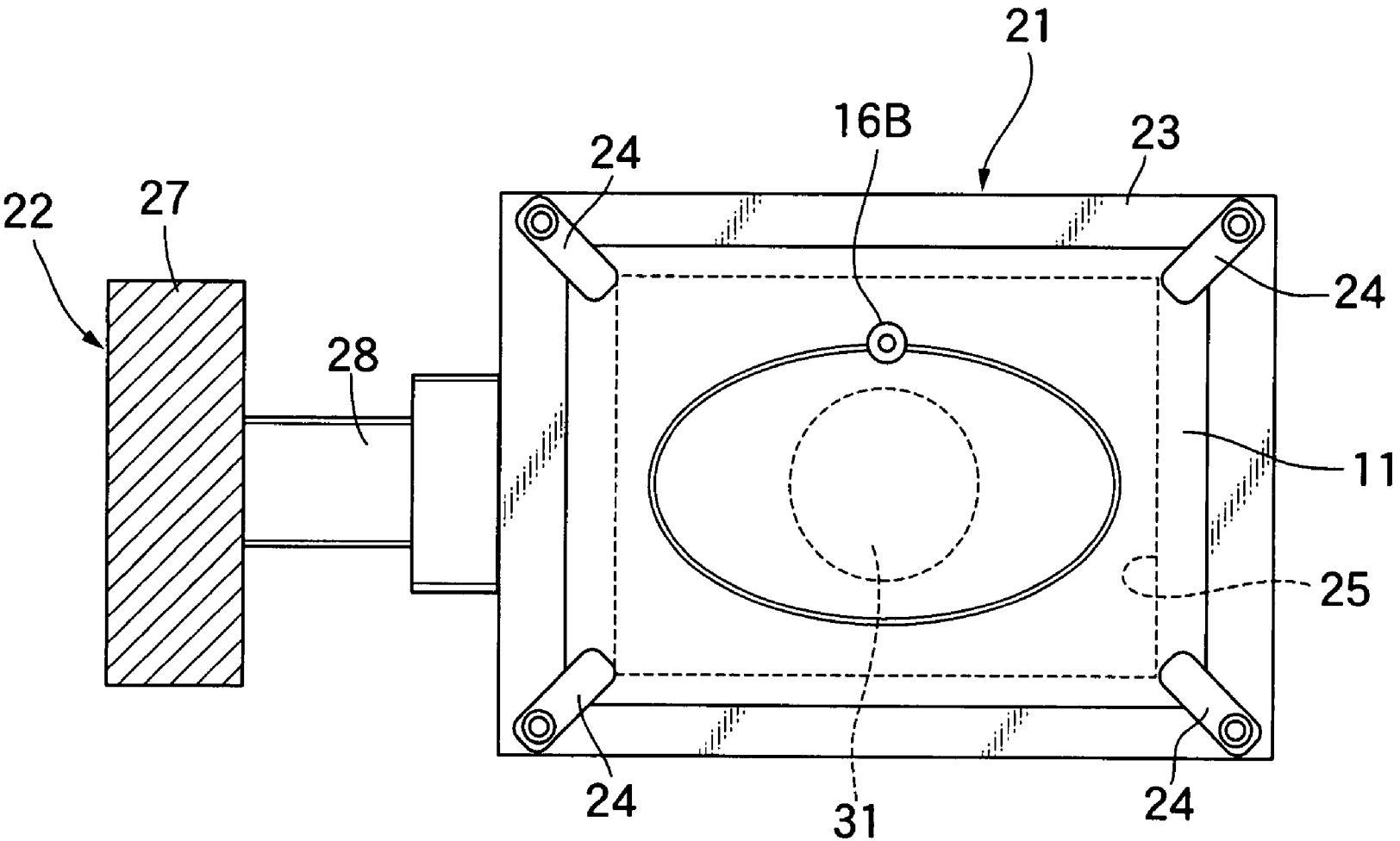
FIG. 4 is a sectional view taken along a line 4-4 in FIG. 3.

Referring also to FIGS. 3 and 4, each of the retainers 21 is comprised of a retaining plate 23 on one surface of which a sheet glass 11 to be cut can be mounted, and an engagement members 24 adapted to be disengageably engaged with a plurality of, e.g., four points of the sheet glass 11 so that the sheet glass 11 is reliably retained on the one surface of the retaining plate 23. Moreover, the retaining plate 23 is provided with an opening 25 which is formed to surround a cutting shape of the sheet glass 11 retained on the retaining plate 23. The cutting shape is determined in correspondence to a contour shape of a mirror for a vehicle, and the opening 25 is formed into a shape surrounding the mirror for the vehicle to be produced by the cutting of the sheet glass.

Each of the lifting/turning mechanisms 22 includes a lifting support frame 26 mounted to stand on an outer periphery of the table 20, a lift arm 27 which is formed into a substantially L-shape and liftably supported at its upper end on the lifting support frame 26, and a support arm 28 which has an axis extending horizontally in a radial direction of the imaginary circle IC and which is carried at a lower end of the lift arm 27 to turn through 180° about the axis. The retaining plate 23 is secured to a tip end of the support arm 28.

In such a glass transferring means 13, the sheet glass 11 set on the retaining plate 23 of the retainer 21 in the throw-in station ST is transferred sequentially through the first processing station SP1 and the second processing station SP2 to the discharge station SD. Glass waste 29 (see FIG. 1) produced in cutting the sheet glass by a water-jet processing in the first and second processing station SP1 and SP2, is removed from the surface of the retaining plate 23 in the discharge station SD, and the retainer 21 is returned again to the throw-in station ST.

Moreover, during transfer of the sheet glass between the first and second processing stations SP1 and SP2, the retaining plate 23, i.e., the sheet glass 11 is turned over by turning of the support arm 28 through 180°.

The water tank 14 is formed into a substantially L-shape in such a manner that it is placed on the base 12 to extend between the first and second processing stations SP1 and SP2. Between the throw-in station ST and the first processing station SP1 as well as between the second processing station SP2 and the discharge station SD, the lift arm 28 of the lifting/turning mechanism 22 in the glass transferring means 13 is lifted and lowered so that the retaining plate 23 can clime over a sidewall of the water tank 14. Between the first and second processing stations SP1 and SP2, the lift arm 28 of the lifting/turning mechanism 22 in the glass transferring means 13 is lifted and lowered so that the retaining plate 23 is turned over above the water tank 14.

Moreover, a vacuum attracting means 31 for releasably attracting a product produced by cutting the sheet glass 11, i.e., a mirror for a vehicle, is disposed within the water tank 14 in the second processing station SP2, so that it attracts the sheet glass 11 from the opening 25 in the retaining plate 23.

The water jet nozzles 16A and 16B each having a nozzle diameter of, for example, 0.7 to 1.5 mm are supported respectively at tip ends of arms 32A and 32B of the NC devices 15A and 15B in such a manner that each nozzle can move from above to a position with a distance, for example 2 to 3 mm, from the sheet glass 11 retained on the retaining plate 23 in each of the first and second processing stations SP1 and SP2. Moreover, the NC devices 15A and 15B are capable of moving the arms 32A and 32B, i.e., the water jet nozzles 16A and 16B freely in a three-dimensional space, and is operated so that in a state in which the sheet glass 11 is at rest in a predetermined position in water in each of the first and second processing stations SP1 and SP2, each of the water jet nozzles 16A and 16B moved close to the sheet plate 11 from above is moved at a speed of, for example, 2,000 mm/min to 5,000 mm/min along the cutting shape, and then retreated from each of the first and second processing stations SP1 and SP2.

The high-pressure water supply sources 17A and 17B are disposed, for example, on a side in the base 12 in such a manner that water of a high pressure, for example, in a range of 200 to 294 MPA can be supplied to the water jet nozzles 16A and 16B. The high-pressure water supply sources 17A and 17B are connected to the water jet nozzles 16A and 16B through high-pressure water pipes 33A and 33B.

The abrasive supply sources 18A and 18B are disposed, for example, on the NC devices 15A and 15B in such a manner that they supply an abrasive, e.g., a garnet at a supply rate, for example, in a range of 100 to 200 g/min.

Figure 5A:
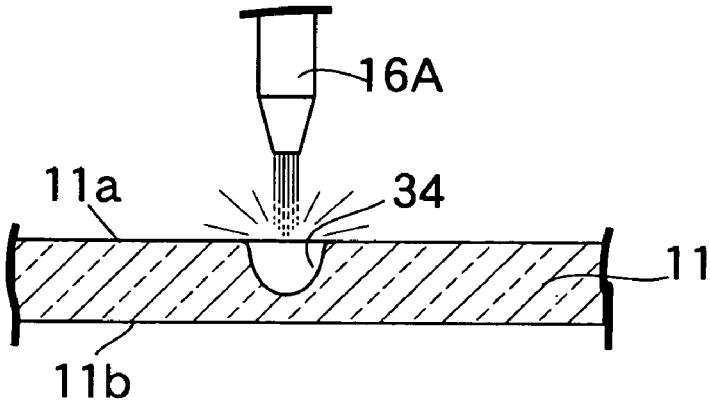
FIGS. 5A, 5B and 5C are sectional views sequentially showing steps of cutting a sheet glass.
Figure 5B:
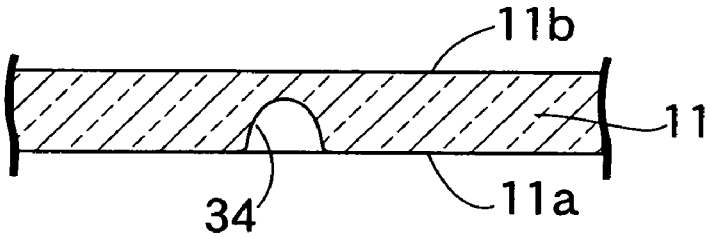
Figure 5C:
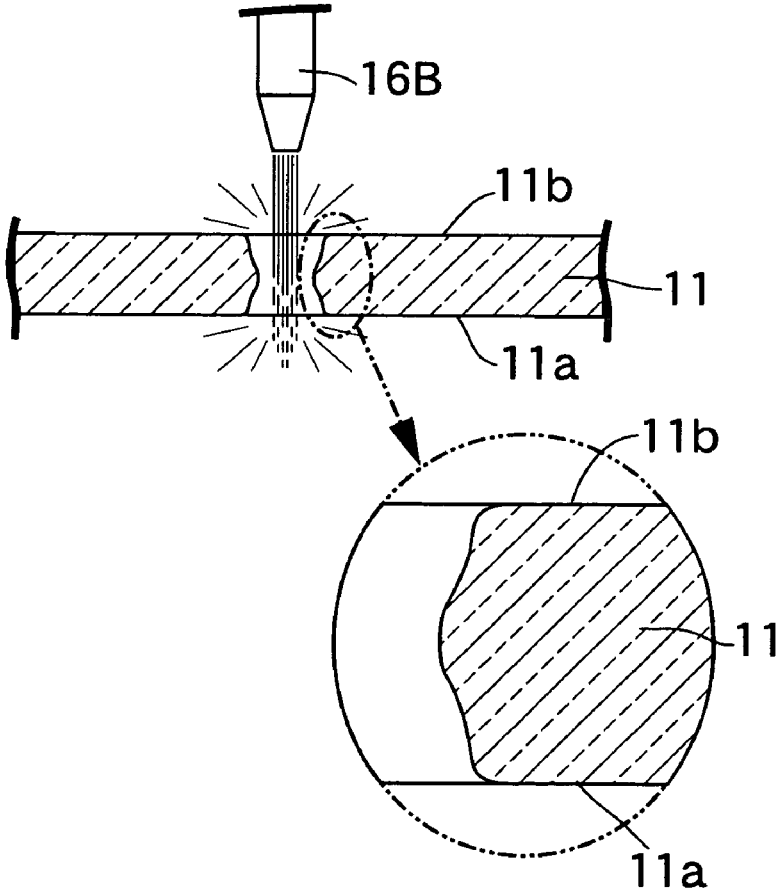

The above-described cutting apparatus cuts the sheet glass 11 by sequentially carrying out, in water, a first step of forming a groove 34 corresponding to the cutting shape in one surface of the sheet plate 11 by a water jet and a second step of forming a groove on the other surface of the sheet glass 11 by a water jet to reach the groove 34 formed at the first step. At the first step, a water current containing an abrasive is injected from the water jet nozzle 16A onto one surface 11*a* of the sheet glass 11 retained on one surface of the retaining plate 23 and brought into water in the first processing station SP1, as shown in FIG. 5A, and thus a groove 34 corresponding to the cutting shape is formed in the one surface of the sheet glass 11 by moving the water jet nozzle 16A along the cutting shape. Then, the sheet glass 11 is transferred from the first processing station SP1 into water in the second process station SP2, but the other surface 11*b* of the sheet glass 11 is turned to face upwards, as shown in FIG. 5B, by turning over the retaining plate 23 during the process of the transfer of the sheet glass 11 from the first processing station SP1 to the second processing station SP2. At the second step, as shown in FIG. 5C, a water current containing an abrasive is injected from the water jet nozzle 16B onto the other surface of the sheet glass 11 brought into the water in the second processing station SP2, a groove is thus formed in the other surface 11*b* of the sheet glass 11 by water jet to reach the groove 34 formed at the first step by moving the water jet nozzle 16B along the cutting shape, whereby the sheet glass 11 is cut along the cutting shape. At this time, the waste left after the cutting and the retaining plate 23 are brought to the discharge station SD, but the product cut out from the cutting along the cutting shape remains attracted to the vacuum attracting means 31 while the retaining plate 23 is transferred to the discharge station SD. The product can be obtained from the inside of the water tank 14 by stopping the attraction provided by the vacuum attracting means 31 after the transfer of the retaining plate 23.

The operation of this embodiment will be described below. When the sheet glass 11 is cut by the water jets, the following steps are carried out sequentially: the first step of forming the groove 34 corresponding to the cutting shape in the one surface 11*a* of the sheet glass 11 by the water jet; and the second step of forming the groove in the other surface 11*b* to reach the groove 34 by the water jet, thereby cutting the sheet glass. In this manner, the sheet glass 11 is cut by forming the grooves from the opposite surfaces 11*a* and 11*b* of the sheet glass 11 by the water jets. Therefore, it is possible to prevent to the utmost breaking or cracking which is liable to occur when water flow of the water jet penetrates the sheet glass, and a sharp edge formed by the penetration of the water flow cannot be created, and thus it is unnecessary to conduct the post-processing such as a chamfering.

In addition, the first and second steps are carried out in the water, and hence it is possible to inhibit the bouncing-back of the cutting water occurring as the water flow does not penetrate the sheet glass 11, and it is also possible to suppress generation of noise due to collision of the water flow against the sheet glass 11.

Moreover, the cutting apparatus employed to cut the sheet glass 11 includes the retaining plate 23 which is capable of releasably retaining on one surface the sheet glass 11 to turn over the sheet glass 11 through 180 degrees and which is provided with the opening 25 formed to surround the cutting shape of the sheet glass 11, and the water jet nozzles 16A and 16B capable moving in correspondence to the cutting shape, while injecting the water flows containing the abrasive toward the sheet glass 11 retained on the retaining plate 23. Thus, the water flows from the water jet nozzles 16A and 16B can be injected toward the opposite surfaces of the sheet glass 11, while being moved in correspondence to the cutting shape, and the cutting process for cutting the sheet glass 11 by forming the grooves from the opposite sides of the sheet glass 11 by the water jets can be carried out easily in the simple structure.

In addition, the cutting apparatus includes the glass transferring means 13 which has the plurality of, e.g., four retaining plates 23 and which transfers each of the retaining plates 23 between the first and second processing stations SP1 and SP2 provided at the distance and turns over each of the retaining plates 23 through 180 degrees, during the transfer, the retaining plate 23 between the first and second processing stations SP1 and SP2, and the pair of water jet nozzles 16A and 16B disposed between the first and second processing stations AP1 and SP2 and adapted to synchronously inject the water flows containing the abrasive. Thus, the sheet glass 11 can be cut effectively, while being transferred by the glass transferring means 13, and a large number of the sheet glasses can be effectively.

Further, the high-pressure water supply sources 17A and 17B having the water pressure set in a range of 200 to 249 MPA and the abrasive supply sources 18A and 18B for supplying the abrasive at the rate in the range of 100 to 200 g/min are connected to the water jet nozzles 16A and 16B, and the NC devices 15A and 15B for moving the water jet nozzles 16A and 16B at the speed in the range of 2,000 to 5,000 mm/min are also connected to the water jet nozzles 16A and 16B. Therefore, the water jet nozzles 16A and 16B can be moved in a locus conformed with a good accuracy to the cutting shape, whereby the sheet glass 11 can be cut under optimal conditions in which cutting quality is enhanced.

Moreover, the cutting shape for cutting the sheet glass 11 is determined in correspondence to a contour of a mirror for a vehicle, and the water jet nozzles 16A and 16B are moved in the three-dimensional space by the NC devices 15A and 15B. Therefore, a mirror for a vehicle curved entirely or partially and slightly can be produced directly without a post-processing by cutting a sheet glass to be curved slightly in correspondence to the mirror for the vehicle, so that the process and apparatus according to the present invention are suitable for production of a mirror for a vehicle.

Although the embodiment of the present invention has been described in detail, it will be understood that the present invention is not limited to the above-described embodiment, and various modifications in design may be made without departing from the subject matter of the invention defined in the claims.

For example, the water jet nozzles 16A and 16B individually corresponding to the first and second processing station SP1 and SP2 as well as the NC devices 15A and 15B individually corresponding to the water jet nozzles 16A and 16B are employed in the embodiment, but a single water jet nozzle common to the first and second processing station SP1 and SP2 may be employed.

What is claimed is:

1. A process for cutting a sheet glass by a water jet, comprising a first step of forming a first groove corresponding to a cutting shape in one surface of the sheet glass by a water jet, and a second step of forming a second groove in the other surface of the sheet glass by a water jet, the second groove having a sufficient depth to reach the first groove, wherein each of the first and second steps are carried out with the sheet glass submerged in a water bath, and wherein the sheet glass is turned over in an intermediate step between the first and second steps so that during said second step, the water jet is directed toward the sheet glass from the side as it was during the first step.

2. A process for cutting a sheet glass according to claim 1, wherein the first groove and the second groove intersect along the entire length of the first groove.

* * * * *